US008414826B2

(12) United States Patent
Tofuku et al.

(10) Patent No.: US 8,414,826 B2
(45) Date of Patent: Apr. 9, 2013

(54) TUNDISH NOZZLE EXCHANGING DEVICE, AND TUNDISH NOZZLE FOR USE IN THE DEVICE

(75) Inventors: Hiroyuki Tofuku, Kitakyushu (JP); Takashi Kayashima, Kitakyushu (JP); Kiyonori Hara, Kitayushu (JP)

(73) Assignee: Krosaki Harima Corporation, Kitakyushu-shi (JP)

( * ) Notice: Subject to any disclaimer, the term of this patent is extended or adjusted under 35 U.S.C. 154(b) by 0 days.

(21) Appl. No.: 12/810,050

(22) PCT Filed: Dec. 26, 2008

(86) PCT No.: PCT/JP2008/073779

§ 371 (c)(1),
(2), (4) Date: Aug. 16, 2010

(87) PCT Pub. No.: WO2009/084654

PCT Pub. Date: Jul. 9, 2009

(65) Prior Publication Data

US 2011/0204103 A1 Aug. 25, 2011

(30) Foreign Application Priority Data

Dec. 28, 2007 (JP) ..... 2007-340216

(51) Int. Cl.
*B22D 41/50* (2006.01)

(52) U.S. Cl. ..... 266/236; 266/287; 222/600; 222/606

(58) Field of Classification Search ..... 266/236, 266/287; 222/600, 606, 607; 164/337, 335, 164/437, 435

See application file for complete search history.

(56) References Cited

U.S. PATENT DOCUMENTS

| | | | | |
|---|---|---|---|---|
| 5,879,579 | A * | 3/1999 | Yoshino et al. | 222/606 |
| 2003/0029892 | A1 * | 2/2003 | Kawano et al. | 222/606 |
| 2011/0062193 | A1 | 3/2011 | Sadano et al. | |

FOREIGN PATENT DOCUMENTS

| | | |
|---|---|---|
| JP | 10 286658 | 10/1998 |
| JP | 11 10293 | 1/1999 |
| JP | 2000 61620 | 2/2000 |

OTHER PUBLICATIONS

U.S. Appl. No. 12/990,820, filed Jan. 20, 2011, Funato, et al.

* cited by examiner

*Primary Examiner* — Scott Kastler
(74) *Attorney, Agent, or Firm* — Oblon, Spivak, McClelland, Maier & Neustadt, L.L.P.

(57) ABSTRACT

A device for exchanging tundish nozzles juxtaposed at a bottom of a tundish includes a pair of first arms and a pair of second arms. The pair of first arms presses and supports a first lower nozzle. The first lower nozzle is located at an undersurface of a first upper nozzle. The first upper nozzle us placed at the bottom of the tundish. The pair of second arms presses and supports a second lower nozzle. The second lower nozzle is located at an undersurface of a second upper nozzle. The second upper nozzle is places at the bottom of the tundish and next to the first upper nozzle. The pair of first arms and the pair of second arms are adjoined to each other, and the pairs at least partly overlap each other.

4 Claims, 9 Drawing Sheets

PRIOR ART

TUNDISH NOZZLE EXCHANGING DEVICE, AND TUNDISH NOZZLE FOR USE IN THE DEVICE

TECHNICAL FIELD

The present invention relates to a tundish nozzle exchanging device and a tundish nozzle for use in the device, which are employed in a continuous caster, and in particular, relates to a device for exchanging tundish nozzles juxtaposed at a bottom of a tundish and a tundish nozzle for use in the device.

BACKGROUND ART

A continuous caster is used for manufacturing semi-finished products having a predetermined shape by solidifying molten steel while further removing impurities from molten steel, after a secondary refining process. As shown in FIG. 9, the continuous caster comprises a ladle 51, a tundish 52, a mold 53, supporting rolls 54, and a torch cutter (not illustrated) placed at the end of the caster.

If a surface level of molten steel in the mold 53 fluctuates during continuous casting, a cast slab may have a surface defect. Thus, an amount of molten steel discharged from the tundish 52 has to be controlled as constant as possible. A variety of methods have been introduced for controlling molten steel flow, and the most simple and the easiest method herein is an open-pouring method. In the open-pouring method, molten steel is poured into a mold from a nozzle opening of a constant dimension, which is placed at the bottom of the tundish 52, such that molten steel is exposed to the atmosphere (or atmosphere gas) without using a tube such as an immersion nozzle.

Although a tundish nozzle used in this open-pouring method is made of high strength refractories such as zircon series or zirconia series, the tundish nozzle is inevitably affected by chemical and mechanical action from molten steel. As time passes, a nozzle bore becomes larger due to corrosion and accretion grows to cause nozzle clogging, which makes it difficult to maintain a predetermined casting speed. For this reason, a regular replacement of the tundish nozzles is required, and apparatuses enabling the replacement of the tundish nozzles during casting operation have been developed (See Patent Documents 1 and 2, for examples).

As shown in FIG. 9, the tundish nozzle comprises the upper nozzle 57 placed inside of a refractory formed at the bottom of the tundish 52; and the lower nozzle 58 pressed and supported at an undersurface of the upper nozzle 57. A tundish nozzle exchanging device 56 exchanges this lower nozzle 58. Beside the lower nozzle 58 during casting operation, a lower nozzle 59 is placed for next replacement. Now, a hydraulic cylinder 60 pushes the lower nozzle 59 for replacement toward the lower nozzle 58. Then, the lower nozzle 58 during casting operation is displaced from the casting position thereof, and the lower nozzle 59 is set at the casting position.

[Patent Document 1] Japanese Unexamined Patent Application Publication No. 10-286658

[Patent Document 2] Japanese Unexamined Patent Application Publication No. 11-10293

DISCLOSURE OF INVENTION

Problems to be Solved by the Invention

The tundish nozzle exchanging device has a pair of arms, pressing and supporting the lower nozzle at the undersurface of the upper nozzle; and sliding means, laterally sliding the lower nozzle (or a blank plate without a hole). If the tundish nozzles are juxtaposed at the bottom of the tundish, the pairs of the arms and the sliding means for the respective tundish nozzles are also juxtaposed. In the conventional tundish nozzle exchanging device, the opposed arms have a distance of approximately 300 mm between the outer edges of one arm and the other arm. Thus, when the pairs of the arms and the sliding means are simply juxtaposed, a distance between holes of the tundish nozzles has to be 300 mm or more. It has been considered that the distance between the holes of the tundish nozzles cannot be 250 mm or less even with the downsized components of the device. Therefore, an H-shaped steel beam having a short beam depth, etc., has been produced by casting with the single nozzle placed at a middle position of a web. However, the H-shaped steel beam can be produced by casting more efficiently with the nozzles placed at each flange position.

The present invention has been made in view of the above circumstances and has an object to provide a tundish nozzle exchanging device and a tundish nozzle for use in the device, in which a distance between holes of tundish nozzles juxtaposed at a bottom of a tundish can be shorter than that of conventional model.

Means for Solving the Problems

To accomplish the above object, the present invention provides a device for exchanging tundish nozzles juxtaposed at a bottom of a tundish, comprising: a pair of first arms pressing and supporting a first lower nozzle, the first lower nozzle located at an undersurface of a first upper nozzle, the first upper nozzle placed at the bottom of the tundish; and a pair of second arms pressing and supporting a second lower nozzle, the second lower nozzle located at an undersurface of a second upper nozzle, the second upper nozzle placed at the bottom of the tundish and next to the first upper nozzle, wherein the pair of first arms and the pair of second arms are adjoined to each other, and the pairs are at least partly overlapped each other.

The term "tundish nozzle" as used herein indicates a collective term for upper nozzles and lower nozzles.

Also, the phrase "at least partly overlapped each other" as used herein does not necessarily means that the adjacent pairs of the arms need to be in contact with each other, but means that at least a part of the pairs of the first arms and the second arms exists in the same area when viewed from the above and/or side. For example, the tundish nozzle exchanging device may be structured so that each first arm and each second arm has a fulcrum at a central portion thereof; each first arm has projecting portions formed at both sides of one edge portion thereof and biasing means placed in the projecting portions, the other edge portion of each first arm presses and supports the first lower nozzle using the biasing means; and each second arm has projecting portions formed at both sides of one edge portion thereof and biasing means placed in the projecting portions, the other edge portion of each second arm presses and supports the second lower nozzle using the biasing means; and further, the projecting portions of one of the first arms are inserted into depressed portions of one of the second arms adjoining to the first arm, the depressed portions formed between the projecting portions of the second arm.

In the present invention, the adjoining pairs of the first arms and the second arms are at least partly overlapped each other, so that a gap between lines replacing the first lower nozzle and the second lower nozzle can be shorter than that of the conventional model where the adjoining pairs of the same are simply juxtaposed. Accordingly, the distance between the holes of the respective tundish nozzles can be shorter than that of the conventional model.

For the tundish nozzle exchanging device according to the present invention, it is preferable that $F_1 \cdot X_1 = F_2 \cdot X_2$ and $Y_1 = Y_2$, where $F_1$ is a biasing force acting on the one edge portion of each first arm; $X_1$ is a distance between points of application of the biasing force and the fulcrum in each first arm; $Y_1$ is a distance between the fulcrum and the other edge portion of each first arm pressing and supporting the first lower nozzle; $F_2$ is a biasing force acting on the one edge portion of each second arm; $X_2$ is a distance between points of application of the biasing force and the fulcrum in each second arm; and $Y_2$ is a distance between the fulcrum and the other edge portion of each second arm pressing and supporting the second lower nozzle.

Each distance as used herein indicates a distance in a direction perpendicular to a sliding direction of the lower nozzles.

The tundish nozzle exchanging device according to the present invention is based on the principle of the lever: where the central portion of the arm is a fulcrum, the biasing force is applied to the one edge portion of the arm, and the other edge portion of the arm presses and supports the lower nozzle. In the present invention, moments acting on the arms are set to be equal so that pressing forces acting on the lower nozzles are to be equal, which is described by the formulas of $F_1 \cdot X_1 = F_2 \cdot X_2$ and $Y_1 = Y_2$.

For the tundish nozzle exchanging device according to the present invention, it is preferable that each first arm has the points of application of the biasing force located symmetrically with respect to the centerline thereof, and each second arm has the points of application of the biasing force located symmetrically with respect to the centerline thereof.

The term "centerline" as used herein indicates a theoretical line passing through the fulcrum of each arm and perpendicular to the sliding direction of the lower nozzles.

In the present invention, the points of application of the biasing force are located symmetrically with respect to the centerline of each arm. Thus, the pressing forces equally act on the lower nozzles.

A tundish nozzle used in the tundish nozzle exchanging device according to the present invention includes the upper nozzle and the lower nozzle, each of which is a zirconia based nozzle inserted into an alumina based refractory.

This structure prevents breakages of the zirconia based nozzles caused by cracks emerged thereon during use, reducing the size of the zirconia based nozzles. Accordingly, the sizes of the upper nozzles and the lower nozzles can be reduced, and the distance between the holes of the tundish nozzles can be shorter than that of the conventional model.

In the present invention, it is preferable that each lower nozzle has a width between 79 mm and 120 mm at an upper end surface.

The term "width", at the upper end surface of each lower nozzle, as used herein indicates a width in the direction perpendicular to the sliding direction of the lower nozzles.

The shorter the width at the upper end surface of each lower nozzle is, the narrower the distance between the holes of the tundish nozzles can be. However, if the width is too short, a tolerance of the lower nozzle is decreased. Thus, the width between 79 mm and 120 mm is preferable.

Additionally in the present invention, the lower nozzles include blank plates without holes.

In the present invention, it is also preferable that each upper nozzle has an outside diameter between 100 mm and 200 mm.

The outside diameter of the upper nozzle is restricted by a distance between the fulcrums of the arms. Thus, the distance between the fulcrums of the arms has to be reduced in order to reduce the distance between the holes of the tundish nozzles. If the outside diameter of the upper nozzle exceeds 200 mm, the distance between the holes of the tundish nozzles becomes too long. On the other hand, if the outside diameter of the upper nozzle is less than 100 mm, the undersurface of the upper nozzle does not have an enough area to be supported by a frame. As a result, the upper nozzle becomes unstable on the frame during use.

EFFECT OF THE INVENTION

The present invention discloses the device for exchanging tundish nozzles juxtaposed at the bottom of the tundish, wherein the adjoining pairs of the first arms and the second arms are at least partly overlapped each other, so that a gap between lines replacing the first lower nozzle and the second lower nozzle can be shorter than that of the conventional model where the adjoining pairs of the same are simply juxtaposed. Accordingly, the distance between the holes of the respective tundish nozzles can be shorter than that of the conventional model.

The tundish nozzle used in the tundish nozzle exchanging device according to the present invention includes the upper nozzles and the lower nozzles, each of which is a zirconia based nozzle inserted into an alumina based refractory. This structure prevents breakages of the zirconia based nozzles caused by cracks emerged thereon during use, reducing the size of the zirconia based nozzles. Accordingly, the sizes of the upper nozzles and the lower nozzles as well as the distance between the holes of the tundish nozzles can be reduced.

BRIEF DESCRIPTION OF DRAWINGS

FIG. 6 (*b*) shows an upper end view and a vertical cross-sectional view of a blank plate.

DESCRIPTION OF REFERENCE NUMERALS

Figure 1:
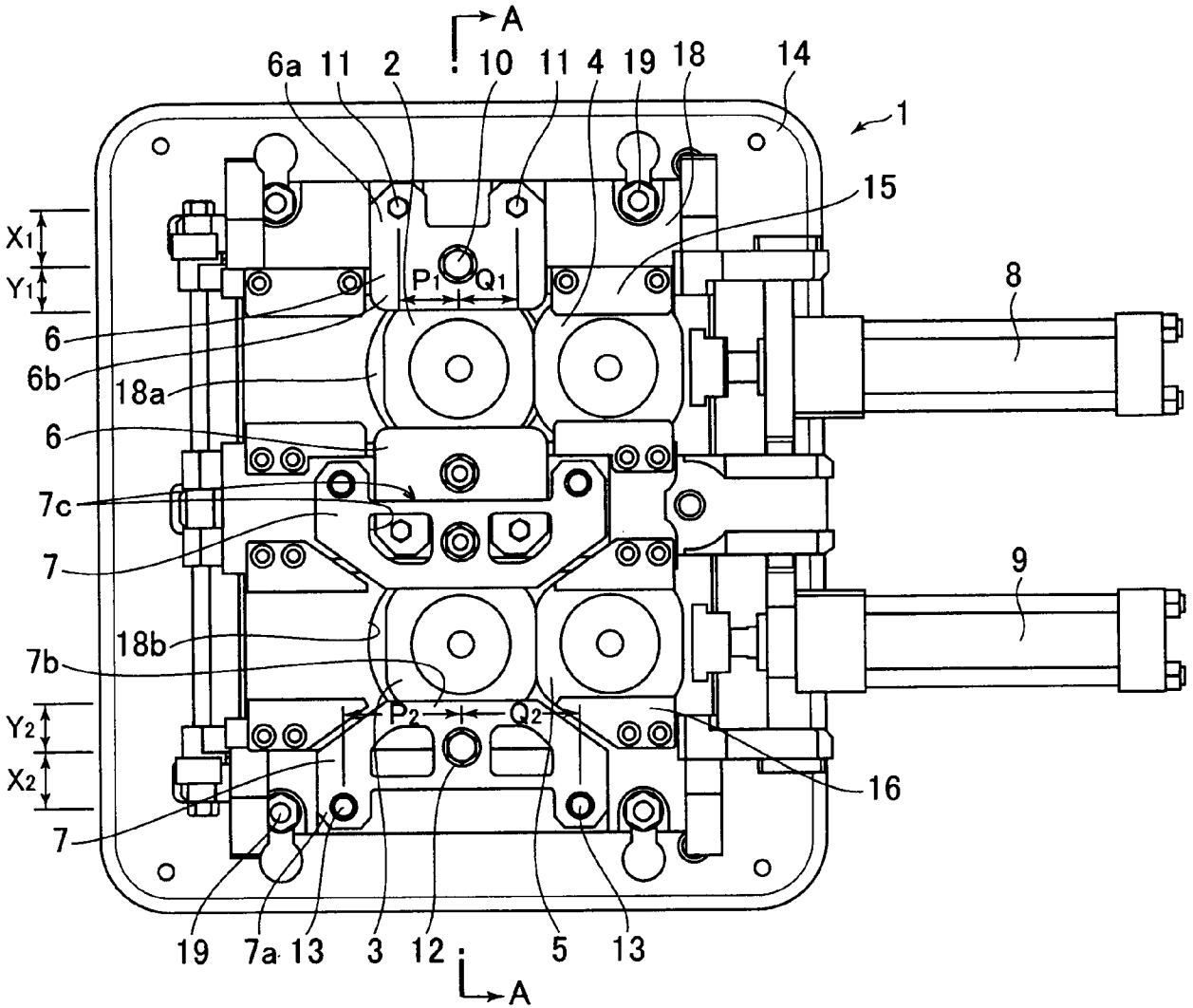
FIG. 1 shows a tundish nozzle exchanging device according to one embodiment of the present invention, when viewed from a bottom of a tundish.

1, 56: tundish nozzle exchanging device
2: first lower nozzle
2*a*, 22*a*: metal case
2*b*, 22*b*: alumina based refractory
2*c*, 22*c*: zirconia based nozzle
2*d*, 22*d*: nozzle hole
3: second lower nozzle
4, 5: lower nozzle for replacement
4*a*: blank plate

6, 36, 46: first arm
6*a*, 7*a*: projecting portion
6*b*, 7*b*: front edge portion
7, 37, 47: second arm
7*c*, 37*c*, 47*c*: depressed portion
8: first hydraulic cylinder
9: second hydraulic cylinder
10, 11, 12, 13, 30, 31, 32, 33, 40, 41, 42, 43: pin
10*a*, 12*a*: spherical bearing
14: base plate
15, 16: guide plate
17: compression spring
18: frame
18*a*: first opening
18*b*: second opening
19: bolt
20, 21: inlet
22: first upper nozzle
23: second upper nozzle
51: ladle
52: tundish
53: mold
54: supporting roll
55: sliding nozzle
57: upper nozzle
58, 59: lower nozzle
60: hydraulic cylinder

BEST MODE FOR CARRYING OUT THE INVENTION

Embodiments of the present invention will be described referring to the accompanying drawings for a better understanding of the present invention.

Hereinafter, the "front" of an arm refers to a side in contact with a lower nozzle and the "back" of the arm refers to the opposite side to the front, for convenience. Also, a direction of "upper" or "lower" is based on a premise that a tundish nozzle exchanging device is placed at a bottom of a tundish.

Figure 2:
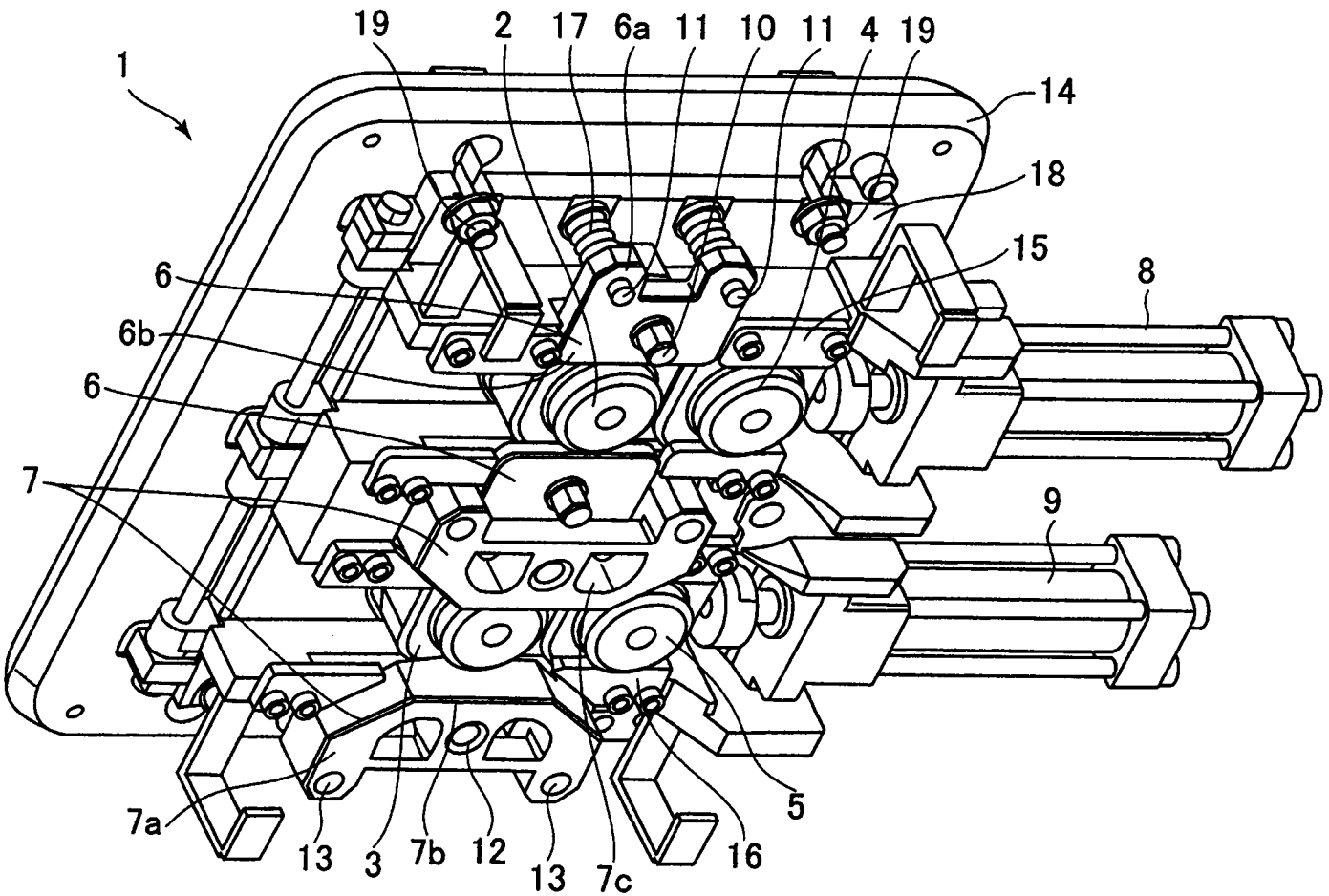
FIG. 2 is a perspective view of the device.

As shown in FIGS. 1 and 2, a tundish nozzle exchanging device 1, according to one embodiment of the present invention, is fixed on a base plate 14 with four bolts 19 via a frame 18 of the device. Here, the base plate 14 is firmly fixed on a bottom of a tundish.

Figure 3:
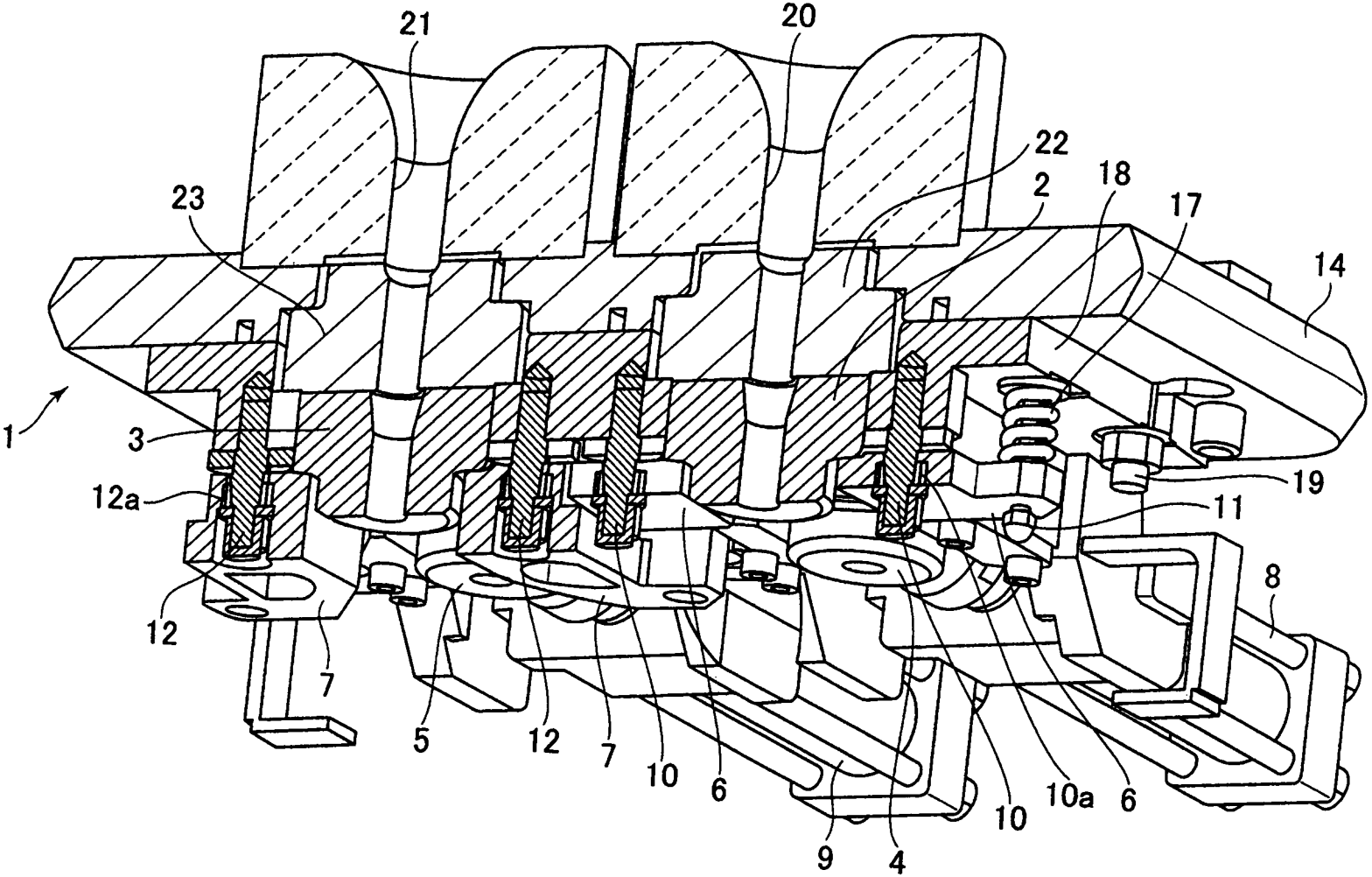
FIG. 3 is a partial cross-sectional perspective view taken on line A-A of FIG. 1.

As shown in FIG. 3, in the middle of the base plate 14 and the frame 18, two openings are formed side by side. A first upper nozzle 22 is inserted into one opening and a second upper nozzle 23 is inserted into the other opening. Thus, the two openings are formed such that holes of the first and second upper nozzles 22, 23 respectively aligned with inlets 20, 21. Here, the inlets 20, 21 are placed side by side at the bottom of the tundish.

The first upper nozzle 22 is inserted into the opening 18*a*. Around a peripheral edge of the opening 18*a*, a pair of first arms 6, 6 is placed opposite each other on the frame 18. The pair of the first arms 6, 6 presses and supports a first lower nozzle 2, which is placed at an undersurface of the first upper nozzle 22. Beside the pair of the first arms 6, 6, a pair of guide plates 15, 15 is placed opposite each other. The pair of the guide plates 15, 15 directs a lower nozzle 4 for replacement toward the first arms 6, 6. Furthermore, at one end of the pair of the guide plates 15, 15, a first hydraulic cylinder 8 is placed for pushing the lower nozzle 4 for replacement toward the first arms 6, 6.

Likewise, the second upper nozzle 23 is inserted into the opening 18*b*. Around a peripheral edge of the opening 18*b*, a pair of second arms 7, 7 is placed opposite each other on the frame 18. The pair of the second arms 7, 7 presses and supports a second lower nozzle 3, which is placed at an undersurface of the second upper nozzle 23. Beside the pair of the second arms 7, 7, a pair of guide plates 16, 16 is placed opposite each other and in parallel with the pair of the guide plates 15, 15. The pair of the guide plates 16, 16 directs a lower nozzle 5 for replacement toward the second arms 7, 7. Furthermore, at one end of the pair of the guide plates 16, 16, a second hydraulic cylinder 9 is placed in parallel with the first hydraulic cylinder 8 for pushing the lower nozzle 5 for replacement toward the second arms 7, 7.

The lower nozzles 2, 3, 4, 5 each have a square shaped upper half and a cylindrical shaped lower half, and the upper half is projecting laterally outward from the lower half. This square shaped upper half, projecting laterally outward, is supported and also pushed sideward by the guide plates 15, 15 or 16, 16. At the same time, each square shaped upper half is pressed and supported by the first arms 6, 6 or the second arms 7, 7 at the undersurface of the upper nozzle 22 or 23.

Configurations and shapes of the upper and lower nozzles are explained in detail hereinbelow.

The first arm 6 has a rectangular shape when viewed from the top, and both sides of a back edge portion thereof respectively have backwardly projecting portions 6*a*, 6*a*. A central portion and the projecting portions 6*a*, 6*a* of the first arm 6 are connected to the frame 18 with pins 10, 11.

On the other hand, the second arm 7 has a trapezoidal shape when viewed from the top, and both sides of a back edge portion thereof respectively have backwardly projecting portions 7*a*, 7*a*. A central portion and the projecting portions 7*a*, 7*a* of the second arm 7 are connected to the frame 18 with pins 12, 13.

As shown in FIG. 3, spherical bearings 10*a*, 12*a* are attached to the pins 10, 12, specifically to the parts of the pins 10, 12 contacting the first arm 6 and the second arm 7. Thus, the first arm 6 and the second arm 7 are pivotally movable in an arbitrary vertical plane. On the other hand, compression springs 17, 17 are attached to the pins 11, 13, and the projecting portions 6*a*, 7*a* of the first arm 6 and the second arm 7 are connected to the frame 18 with looseness in the vertical direction therebetween. The compression springs 17, 17 are the biasing means for biasing the projecting portions 6*a*, 7*a* of the first arm 6 and the second arm 7 downwards. The first arm 6 and the second arm 7 are pivotally movable in a vertical plane, supported by the pins 10, 12 (fulcrums). And, front edge portions 6*b*, 7*b* press and support the square shaped upper halves of the first lower nozzle 2 and the second lower nozzle 3 upward from below.

The second arm 7 is thicker than the first arm 6. The back edge portion of the second arm 7 includes depressed portions 7*c*, 7*c* having backward openings. The projecting portions 6*a*, 6*a* of the adjoining first arm 6 are inserted into the depressed portions 7*c*, 7*c* having backward openings, in which the pin 12 (fulcrum of the second arm 7) is placed between the projecting portions 6*a*, 6*a*. In other words, the first arm 6 is located between the projecting portions 7*a*, 7*a* of the second arm 7 when viewed from the bottom, and the projecting portions 6*a*, 6*a* are covered by the central portion of the second arm 7 when viewed from the side.

The above-described configuration can reduce a gap between lines replacing the first lower nozzle 2 and the second lower nozzle 3, compared with a configuration where the first arms 6, 6 and the second arms 7, 7 are simply juxtaposed.

In addition, the first arms 6, 6 and the second arms 7, 7 are adjoined to each other with clearances, thereby not interfering with each other when they move.

In the device 1 according to the embodiment of the present invention, $F_1 \cdot X_1 = F_2 \cdot X_2$ and $Y_1 = Y_2$, where $F_1$ is a biasing force acting on the positions of the pins 11, 11 of each first arm 6; $X_1$ is a distance between the pins 11, 11 (points of application of the biasing force) and the pin 10 in each first arm 6; $Y_1$ is a distance between the pin 10 and the front end of the front edge portions 6*b*, 6*b* pressing and supporting the first lower nozzle 2; $F_2$ is a biasing force acting on the positions of the pins 13, 13 of each second arm 7; $X_2$ is a distance between the pins 13, 13 (points of application of the biasing force) and the pin 12 in each second arm 7; and $Y_2$ is a distance between the pin 12 and the front end of the front edge portions 7*b*, 7*b* pressing and supporting the second lower nozzle 3 (See FIG. 1). Each distance as used herein indicates a distance in a direction perpendicular to a sliding direction of the lower nozzles 2, 3, 4, 5. Since $F_1 \cdot X_1 = F_2 \cdot X_2$, moment acting on the first arm 6 and the second arm 7 are equal. Also, since $Y_1 = Y_2$, pressing forces acting on the first lower nozzle 2 and the second lower nozzle 3 are equal.

Now, the actual pressing forces respectively acting on the front edge portions 6*b*, 7*b* of the first arm 6 and the second arm 7 are preferably within ±10% of set values. Also, in order to press the lower nozzles 2, 3 as evenly as possible, the front edge portions 6*b*, 7*b* of the first arm 6 and the second arm 7 preferably have widths equal to or longer than those of the upper end surfaces of the lower nozzles 2, 3.

Additionally in the device 1 according to the embodiment of the present invention, since $P_1 = Q_1$ and $P_2 = Q_2$, where $P_1$ and $Q_1$ are distances between the pin 10 and the pair of pins 11, 11 of each first arm 6, and $P_2$ and $Q_2$ are distances between the pin 12 and the pair of pins 13, 13 of each second arm 7, then pressing forces evenly act on the first lower nozzle 2 and the second lower nozzle 3.

In the embodiment of the present invention, $X_1$ and $X_2$ are each 40.5 mm; $Y_1$ and $Y_2$ are each 32.5 mm; $P_1$ and $Q_1$ are each 40 mm; and $P_2$ and $Q_2$ are each 80 mm. Also, the biasing forces $F_1$, $F_2$ are calculated based on spring constants of the compression springs 17, 17 to be used. In this embodiment, the spring constant of each compression spring 17 is 400 N/mm; and amount of deflection of each compression spring 17 in use is 4 mm. Since two compression springs are used in one arm, then the biasing force acting on one arm is 400×4×2=3200N.

Figure 8:
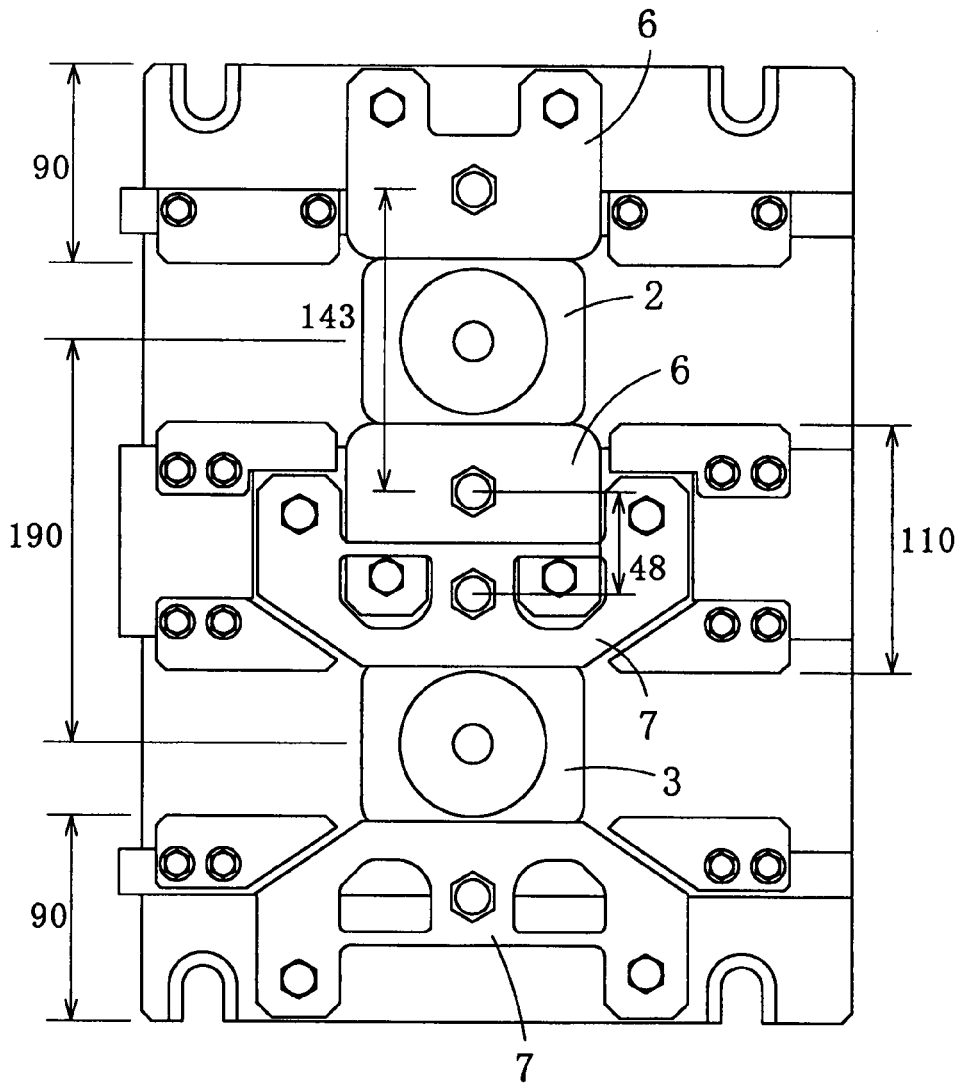
FIG. 8 is a partial enlarged view of FIG. 1.
Figure 9:
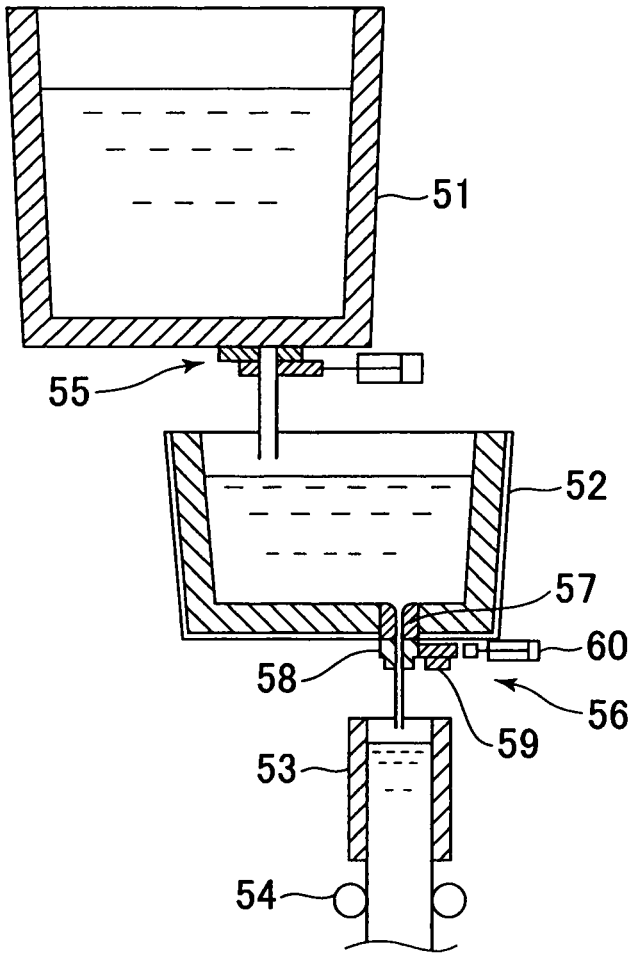
FIG. 9 is a partial schematic view of a general continuous caster.

As shown in FIG. 8, the first arm 6 and the second arm 7 have widths of 90 mm, in the direction perpendicular to the sliding direction of the lower nozzles 2, 3. The adjoining first arm 6 and the second arm 7 have a total width of 110 mm, where they are partly overlapped each other. The lower nozzles 2, 3 and the front edge portions 6*b*, 7*b* of the arms 6, 7 have overlap widths of 10 mm. Accordingly, the distance between holes of the tundish nozzles is 190 mm. In this embodiment, the lower nozzle 2, 3 have widths of 100 mm at the upper surfaces thereof, in the direction perpendicular to the sliding direction thereof.

When the lower nozzles 2, 3 during casting are replaced by using the device 1 with the above-described configurations, the lower nozzles 4, 5 for replacement are set beside the lower nozzles 2, 3 during casting, and the hydraulic cylinders 8, 9 push the lower nozzles 4, 5 toward the arms 6, 7. Then, the guide plates 15, 16 guide the lower nozzles 4, 5 to be set just under the upper nozzles 22, 23, meanwhile the lower nozzles 2, 3 during casting are pushed sidewards by the lower nozzles 4, 5.

In the device 1 according to the embodiment of the present invention, the first lower nozzle 2 and the second lower nozzle 3 can be exchanged simultaneously or at different times. As mentioned above, the first arm 6 and the second arm 7 are adjoined to each other with clearances therebetween, and thus the movement of one arm does not limit that of the other arm.

In order to immediately stop casting operation in case of accidents such as breakouts and overflows, blank plates without holes can be set instead of the lower nozzles 4, 5 for replacement, except when the lower nozzles 2, 3 are to be replaced.

Now, descriptions are given on the upper nozzles, the lower nozzles, and the blank plates used in the tundish nozzle exchanging device.

Figure 4:
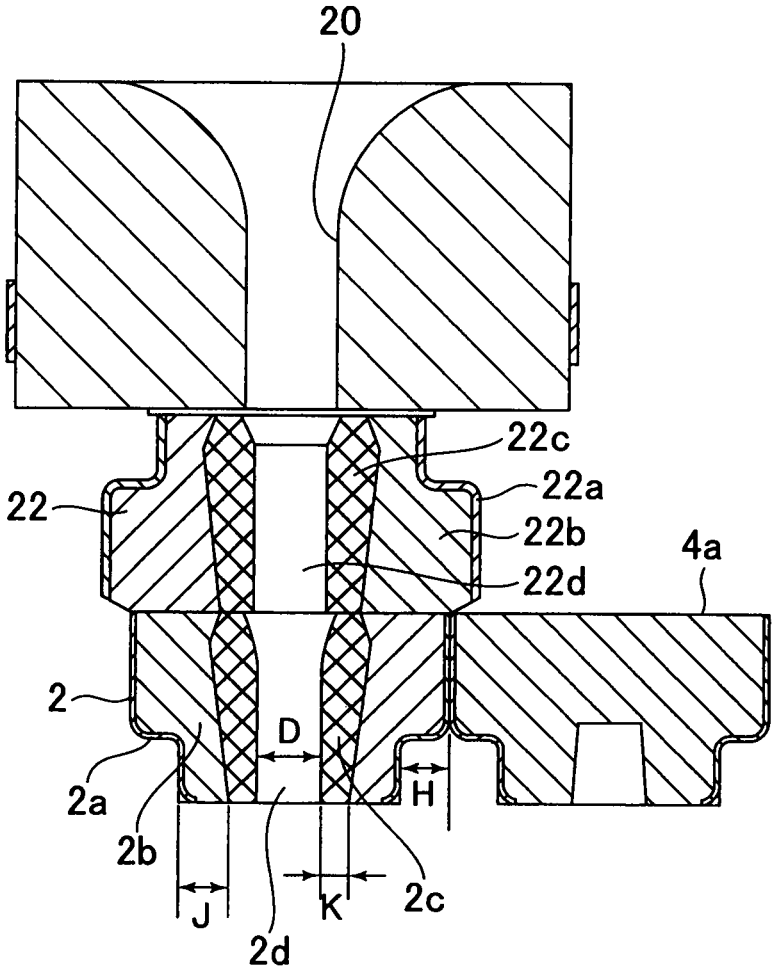
FIG. 4 is a vertical cross-sectional view of a tundish nozzle used in the tundish nozzle exchanging device according to one embodiment of the present invention.
Figure 5:
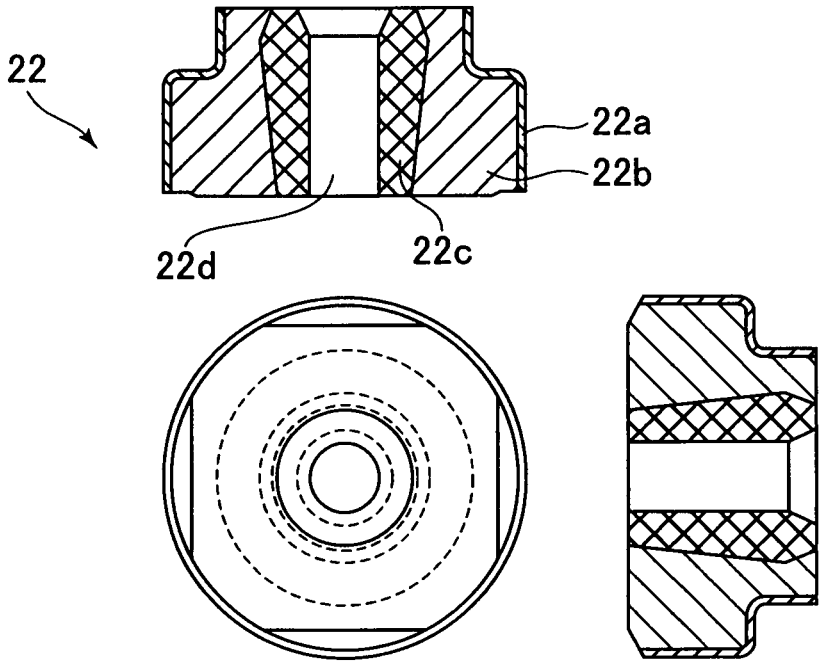
FIG. 5 shows a bottom view and a vertical cross-sectional view of an upper nozzle included in the tundish nozzle.
Figure 6A:
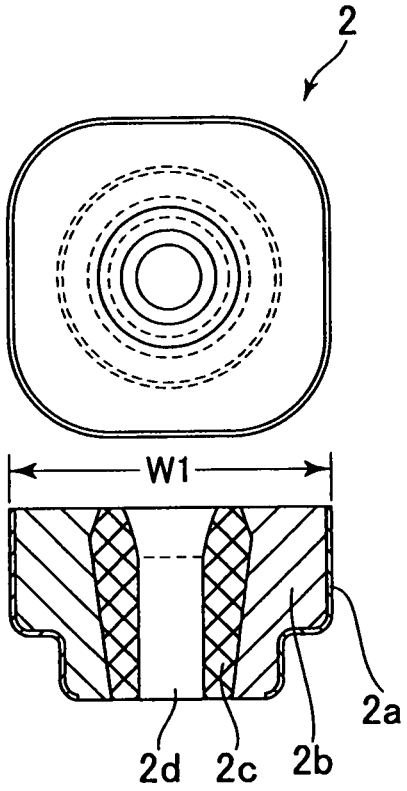
FIG. 6 (*a*) shows an upper end view and a vertical cross-sectional view of a lower nozzle.
Figure 6B:
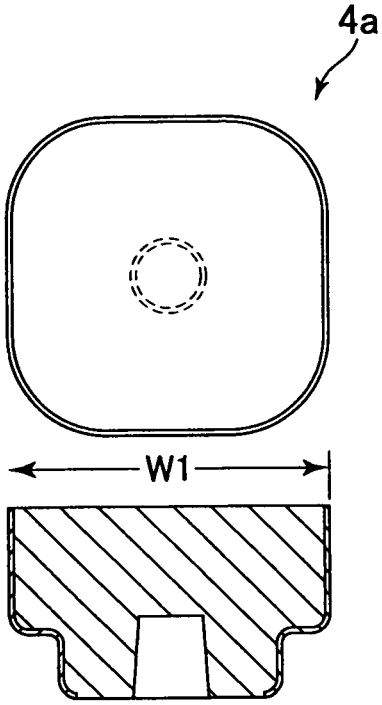

FIG. 4 is a vertical cross-sectional view of a tundish nozzle used in the tundish nozzle exchanging device according to the embodiment of the present invention. FIGS. 5 and 6 show configurations of the upper nozzles, the lower nozzles, and the blank plates. Hereinafter, descriptions are given on the first lower nozzle 2 and the first upper nozzle 22, and the same explanation applies to the second lower nozzle 3 and the second upper nozzle 23. Also, hereinafter, the first lower nozzle and the first upper nozzle are respectively referred to as the lower nozzle and the upper nozzle for simplicity.

As shown in FIGS. 4 to 6, the lower nozzle 2 and the upper nozzle 22 may be the zirconia based nozzles 2*c*, 22*c* inserted into alumina based refractories 2*b*, 22*b*. And further, outer peripheries of the alumina based refractories 2*b*, 22*b* may be covered with metal cases 2*a*, 22*a*. This configuration prevents breakages of the zirconia based nozzles 2*c*, 22*c* caused by cracks emerged thereon during use, which allows the zirconia based nozzles 2*c*, 22*c* to have smaller outside diameters. Accordingly, the upper nozzle 22 and the lower nozzle 2 can be downsized. As a result, it is possible to reduce a contact area of the upper nozzle 22 and the lower nozzle 2, thereby downsizing the first arm 6 (as well as the second arm 7) pressing and supporting the lower nozzle 2, and also the tundish nozzle exchanging device as a whole.

In the lower nozzle 2 and the upper nozzle 22, as a way of winding the alumina based refractories 2*b*, 22*b* around the outer peripheries of the zirconia based nozzles 2*c*, 22*c*, for example, castables can be poured into gaps between the outer peripheries of the zirconia based nozzles 2*c*, 22*c* and the metal case 2*a*, 22*a*. In terms of strength and thermal shock resistance, materials for the castables preferably contain 80% or more by mass of $Al_2O_3$.

The nozzle holes 2*d*, 22*d* of the lower nozzle 2 and the upper nozzle 22 need to have enough sizes in order to ensure molten steel flow. Also, wall thicknesses of the zirconia based nozzles 2*c*, 22*c* need to be reduced in order to ensure a hole diameter D required for the casting operation and to reduce the outside diameters of the zirconia based nozzles 2*c*, 22*c*. To provide the zirconia based nozzles 2*c*, 22*c* having thin wall thicknesses and high tolerances, it is effective to increase $ZrO_2$ mass content of the nozzles. In this sense, the zirconia based nozzles 2*c*, 22*c* preferably contain 75% or more, and more preferably 90% or more, by mass of $ZrO_2$. If the zirconia based nozzles 2*c*, 22*c* contain less than 75% by mass of $ZrO_2$, the nozzles 2*c*, 22*c* are subject to severe corrosion, which makes it difficult to reduce the wall thicknesses of the nozzles 2*c*, 22*c*.

To achieve one of the objects of the present invention, that is to narrow the distance between the holes of the tundish nozzles, as shown FIGS. 6 (*a*) and 6 (*b*), it is effective to shorten widths W1, W1 at the upper end surfaces of the lower nozzle 2 and the blank plate 4*a*. The widths W1, W1 at the upper end surfaces of the lower nozzle 2 and the blank plate 4*a* as used herein indicate widths in a direction perpendicular to a sliding direction of the lower nozzle 2 and the blank plate 4*a*.

The shorter the widths W1, W1 at the upper end surfaces of the lower nozzle 2 and the blank plate 4*a* are, the narrower the distance between the holes of the tundish nozzles can be. If the distance between the holes of the tundish nozzles is too narrow, the tolerances of the nozzles are reduced, and therefore, the distance is preferably 79 to 120 mm, and more preferably 79 to 110 mm.

The lower nozzle 2 requires the following sizes: at least 10 mm of a project width H at the upper portion; up to 25 mm of the hole diameter D; at least 7 mm of a wall thickness K of the lower edge portion of the zirconia based nozzles 2*c*; and at least 10 mm of a wall thickness J of the alumina based refractory 2*b*. By combining these figures, a lower limit of the width W1 at the upper end surface of the lower nozzle 2 is 79 mm (See FIG. 4). On the other hand, if the width W1 at the upper end surface of the lower nozzle 2 exceeds 120 mm, the contact area of the upper nozzle 22 and the lower nozzle 2 becomes large, and accordingly, the first arm 6 (as well as the second arm 7), which presses and supports the lower nozzle 2, has to be enlarged. Therefore, it is difficult to set a distance of 250 mm or less between the holes of the tundish nozzles.

As shown in FIG. 5, the upper nozzle 22 includes the metal case 22*a* of a cylindrical shape, but a portion downwardly exposed from the metal case 22*a* has a square shape with rounded off corners. In other wards, the upper nozzle 22 is a cylindrical shape, having a square shaped lower surface with rounded off corners when viewed from the top, and a length of a diagonal line in this square shaped lower surface is almost the same as an outside diameter of this cylindrical shaped body. Since the upper nozzle 22 has a cylindrical shape, the wall thicknesses to the bore of the upper nozzle 22 become constant in any horizontal sections. Thus, the upper nozzle 22 has a higher resistance to thermal stresses and a better tolerance. Accordingly, the upper nozzle 22 can be smaller, and the distance between the holes of the tundish nozzles can be reduced.

The distance between the holes of the tundish nozzles, as shown in FIG. 3, is affected by set positions of the fulcrums (pins) 10, 12 supporting the arms 6, 7. A distance between these fulcrums is also affected by the size of the upper nozzle 22. In short, in order to reduce the distance between the fulcrums, the outside diameter of the upper nozzle 22 has to be reduced. Thus, in order to provide 250 mm or shorter distance between the holes of the tundish nozzles, the outside diameter of the upper nozzle 22 is preferably 200 mm or less in light of restrictions from dimensions of the components.

In the arms 6, 6 and the arms 7, 7 as shown in FIG. 8, the distances between the fulcrums are 143 mm (142.5 mm to be exact) and the distances between the holes of the tundish nozzles are 190 mm. Thus, in order to provide the distance of 250 mm or less between the holes of the tundish nozzles, the distance between the fulcrums can be increased by 60 mm, in other wards, increased up to 200 mm, which is a maximum outside diameter of the upper nozzle 22. However, in view of interferences with pins (fulcrums) 10, 12, the distances between fulcrums are preferably 180 mm or less. In the embodiment of the present invention, the outside diameter of the upper nozzle 22 is 120 mm.

As shown in FIG. 3, the upper nozzle 22 has the lower end surface in contact with the frame 18, in other wards, supported by the frame 18. If the outside diameter of the upper nozzle 22 becomes smaller, the contact area of the upper nozzle 22 and the frame 18 is reduced, and thus, the upper nozzle 22 becomes unstable on the frame 18 during use. For this reason, to support the upper nozzle 22 stably on the frame 18, the supporting width requires at least 10 mm on each side of the upper nozzle 22. Since a minimum width W1 of the lower nozzle 2 is 79 mm, the outside diameter of the upper nozzle 22 has to be 100 mm or more.

In addition, if the upper nozzle 22 is a polygonal tubular body, a length of a diagonal line of the polygon is regarded as the outside diameter thereof.

Other embodiments of a first arm and a second arm will be described referring to FIG. 7. In the previously-described embodiment, the first arm and the second arm are at least partly overlapped each other when viewed from the bottom and the side. However, in this embodiment, the first arm and the second arm are at least partly overlapped each other when viewed from the side.

Figure 7A:
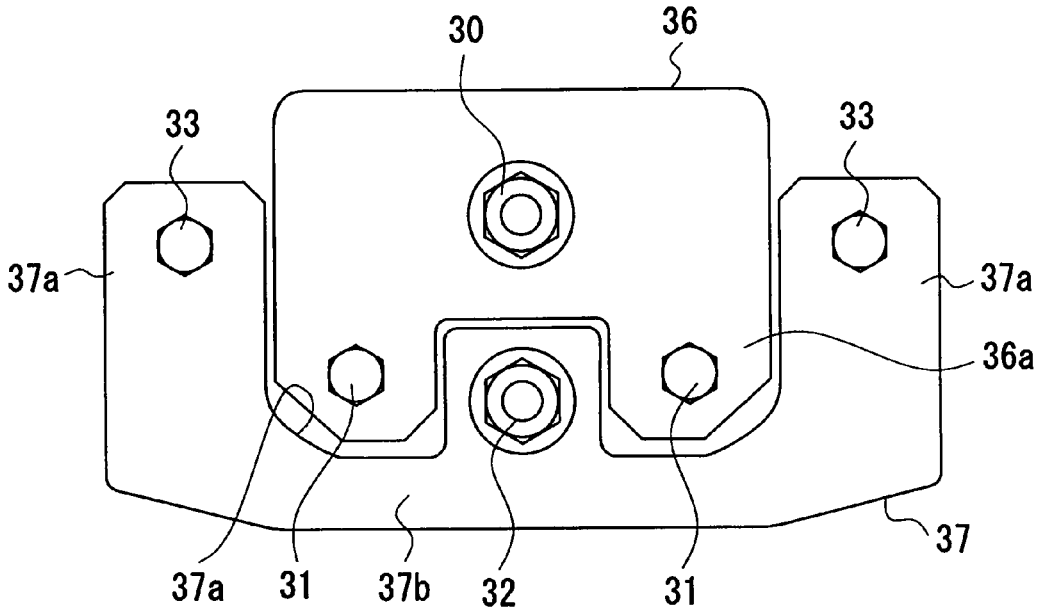
FIG. 7 (*a*) and FIG. 7 (*b*) are plain views of tundish nozzle exchanging devices according to other embodiments of the present invention.
Figure 7B:
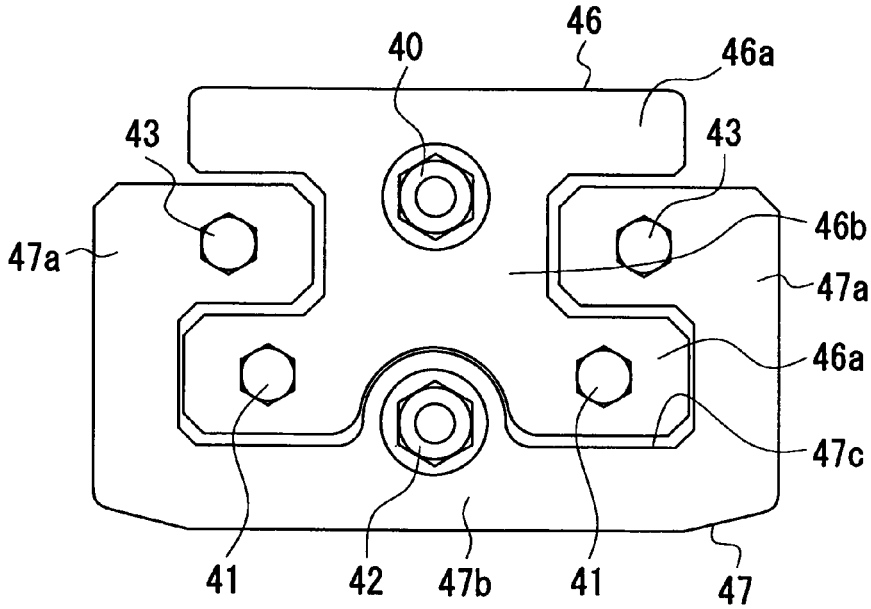

In FIG. 7 (*a*), the first arm 36 is a rectangular shape when viewed from the bottom, and both sides of a back edge portion thereof respectively have projecting portions 36*a*, 36*a*, which are projecting backward. A central portion and the projecting portions 36*a*, 36*a* of the first arm 36 are connected to the frame 18 with pins 30, 31.

On the other hand, the second arm 37 is an E-letter shape when viewed from the bottom, and a web portion 37*b* and both flange portions 37*a*, 37*a* are connected to the frame 18 with pins 32, 33. The web portion 37*b* and both flange portions 37*a*, 37*a* form depressed portions 37*c*, 37*c* having backward openings. The projecting portions 36*a*, 36*a* and about one-half of a central portion of the adjoining first arm 36 are inserted into the depressed portions 37*c*, 37*c* having clearances therebetween.

In FIG. 7 (*b*), the first arm 46 is an H-letter shape when viewed from the bottom, and a web portion 46*b* and both flange portions 46*a*, 46*a* are connected to the frame 18 with pins 40, 41.

On the other hand, the second arm 47 is a C-letter shape when viewed from the bottom, and a web portion 47*b* and both flange portions 47*a*, 47*a* are respectively connected to the frame 18 with pins 42, 43. The web portion 47*b* and both flange portions 47*a*, 47*a* form depressed portions 47*c*, 47*c* having backward openings. The web portion 46*b* and one of the flange portions 46*a* of the adjoining first arm 46 are freely inserted into the depressed portions 47*c*, 47*c*.

While the embodiments of the present invention have been described above, the present invention is not limited to the above-described embodiments, and various modifications may be made without departing from the scope or spirit of the present invention. For example, in the above-described embodiments, two nozzles are juxtaposed each other, but needless to say, three or more nozzles may be juxtaposed each other. In addition, in the above-described embodiments, each arm has a symmetrical configuration, but not necessarily has the symmetrical configuration. In short, modifications can be made as long as expected functions of the present invention are obtained.

INDUSTRIAL APPLICABILITY

The present invention can be used in continuous casting facilities, in which tundish nozzles are juxtaposed each other at a bottom of a tundish. The present invention can make a distance between holes of the tundish nozzles shorter than that of the conventional model.

The invention claimed is:

1. A device for exchanging tundish nozzles juxtaposed at a bottom of a tundish, comprising:

a pair of first arms pressing and supporting a first lower nozzle, the first lower nozzle located at an undersurface of a first upper nozzle, the first upper nozzle placed at the bottom of the tundish; and a pair of second arms pressing and supporting a second lower nozzle, the second lower nozzle located at an undersurface of a second upper nozzle, the second upper nozzle placed at the bottom of the tundish and next to the first upper nozzle, wherein the pair of first arms and the pair of second arms are adjoined to each other, and the pairs are at least partly overlapped each other.

2. The device of claim 1, wherein each first arm and each second arm has a fulcrum at a central portion thereof;

each first arm has projecting portions formed at both sides of one edge portion thereof and biasing means placed in the projecting portions, the other edge portion of each first arm presses and supports the first lower nozzle using the biasing means;

each second arm has projecting portions formed at both sides of one edge portion thereof and biasing means placed in the projecting portions, the other edge portion of each second arm presses and supports the second lower nozzle using the biasing means; and further, the projecting portions of one of the first arms are inserted into depressed portions of one of the second arms adjoining to the first arm, the depressed portions formed between the projecting portions of the second arm.

3. The device of claim 2, wherein $F_1 \cdot X_1 = F_2 \cdot X_2$ and $Y_1 = Y_2$, where $F_1$ is a biasing force acting on the one edge portion of each first arm; $X_1$ is a distance between points of application of the biasing force and the fulcrum in each first arm; $Y_1$ is a distance between the fulcrum and the other edge portion of each first arm pressing and supporting the first lower nozzle; $F_2$ is a biasing force acting on the one edge portion of each second arm; $X_2$ is a distance between points of application of the biasing force and the fulcrum in each second arm; and $Y_2$ is a distance between the fulcrum and the other edge portion of each second arm pressing and supporting the second lower nozzle.

4. The device of claim 3, wherein each first arm has the points of application of the biasing force located symmetrically with respect to the centerline of the first arm, and each second arm has the points of application of the biasing force located symmetrically with respect to the centerline of the second arm.

* * * * *